US005913891A

United States Patent [19]

Clawson

[11] Patent Number: 5,913,891

[45] **Date of Patent: *Jun. 22, 1999**

[54] THERMAL EXPANSION VALVE AND SYSTEM INCLUDING SUCH DEVICE AND METHOD FOR MAKING SUCH DEVICE

[76] Inventor: Lawrence G. Clawson, 7 Rocky Brook Rd., Dover, Mass. 02030

[ * ] Notice: This patent is subject to a terminal disclaimer.

[21] Appl. No.: 09/170,306

[22] Filed: Oct. 13, 1998

Related U.S. Application Data

[62] Division of application No. 08/878,979, Jun. 19, 1997, Pat. No. 5,819,548.

[51] Int. Cl.[6] ..... F25B 41/04

[52] U.S. Cl. ..... 62/225; 236/92 B; 236/102

[58] Field of Search ..... 236/93 R, 92 B, 236/102; 62/225, 222, 513

[56] References Cited

U.S. PATENT DOCUMENTS 2,971,349 2/1961 Orth et al. ..... 62/225

3,294,148 12/1966 Alvarado ..... 236/93 R 4,441,327 4/1984 Klee et al. ..... 236/102

5,819,548 10/1998 Clawson ..... 62/225

*Primary Examiner*—William E. Tapolcal

*Attorney, Agent, or Firm*—Pandiscio & Pandiscio

[57] ABSTRACT

A thermal expansion valve comprises a metal tube for flowing a fluid therethrough, and a metal rod fixed only at a first end in the tube and disposed wholly within the tube, the metal tube having a greater coefficient of expansion than the metal rod. A plug having an orifice therethrough is disposed in the tube proximate a free end of the rod. Lengthwise thermal expansion and contraction of the tube and the rod caused by the temperature of the fluid in the tube and around the rod causes the free end of the rod to retreat from the plug to increase flow of the fluid therethrough, and causes the free end of the rod to approach the plug to restrict flow of the fluid therethrough, respectively.

15 Claims, 3 Drawing Sheets

THERMAL EXPANSION VALVE AND SYSTEM INCLUDING SUCH DEVICE AND METHOD FOR MAKING SUCH DEVICE

CROSS-REFERENCE TO RELATED APPLICATION

This application is a division of U.S. application Ser. No. 08/878,979, filed Jun. 19, 1997 in the name of Lawrence G. Clawson, now U.S. Pat. No. 5,819,548, issued Oct. 13, 1998.

BACKGROUND OF THE INVENTION

1. Field of the Invention

This invention relates to valves and is directed more particularly to a valve responsive to temperature changes of a medium flowing therethrough to modify the rate of flow of the medium therethrough.

2. Description of the Prior Art

In systems, such as refrigeration systems, in which it is important to control the temperature of a liquid flowing into a temperature-sensitive body, such as controlling the temperature of refrigerant entering the evaporator of the refrigeration system, the temperature adjustment means usually is operative in response to a sensed condition in the evaporator indicative of the temperature in the evaporator.

Rather than responding to the temperature of, or in, the evaporator, or other such body, it is deemed beneficial to provide for continuous control of the temperature of the medium entering the body, such that the body is continuously maintained at the most efficient temperature.

Expansion valves have been suggested as a means for controlling the flow of a refrigerant medium into an evaporator of a refrigeration system. An example of such valves is shown in U.S. Pat. No. 2,463,951, issued Mar. 8, 1949 to F. Y. Carter. The Carter valve includes a number of moving parts and is complex and, therefore, expensive.

Other valves of a generally similar nature may be seen in U.S. Pat. No. 3,205,675, issued Sep. 14, 1965 to A. A. Matthies, U.S. Pat. No. 3,405,535, issued Oct. 15, 1968 to A. A. Matthies, and U.S. Pat. No. 3,835,659, issued Sep. 17, 1994 to Lyle E. McBride, Jr.

There exists a need for a valve responsive to the temperature of fluid flowing therethrough to automatically regulate the flow rate of the fluid, to maintain the body to which the fluid is directed at an efficiency optimum temperature, which valve is simple and reliable in construction and inexpensive to obtain and maintain.

SUMMARY OF THE INVENTION

Accordingly, an object of the invention is to provide a thermal expansion valve operable to automatically control flow of fluid therethrough responsive to the temperature of the fluid.

A further object of the invention is to provide such a valve in combination with a first tube interconnecting first and second bodies for flow of fluid from the first body to the second body, and a second tube interconnecting a third body and the first body, for flow of liquid from the third body to the first body, a portion of the second tube being disposed adjacent the first tube, the valve being operable upon the liquid in the second tube to control the rate of flow through the second tube to the first body, to control the temperature of the first body.

A further object of the invention is to provide such a valve in a refrigeration system comprising a first tube interconnecting an evaporator and a compressor for flow of fluid from the evaporator to the compressor, and a second tube interconnecting a condenser and the evaporator for flow of refrigerant from the condenser to the evaporator, a portion of the second tube being disposed adjacent the first tube, the valve being operable to control the rate of flow through the second tube to the evaporator, to control the temperature of the evaporator.

A still further object of the invention is to provide such a valve of simple construction, having few parts, exhibiting ruggedness and reliability, and inexpensive to make and to maintain.

A still further object of the invention is to provide a method for making the valve above described.

With the above and other objects in view, as will hereinafter appear, a feature of the present invention is the provision of a thermal expansion valve comprising a metal tube for flowing a fluid therethrough, and a metal rod fixed only at a first end in the tube and disposed wholly within the tube, the metal tube having a greater coefficient of expansion than the metal rod. A plug having an orifice therethrough is disposed in the tube proximate a free end of the rod. In operation, lengthwise thermal expansion and contraction of the tube and the rod, caused by the temperature of the fluid in the tube and around the rod, causes the free end of the rod to retreat from the plug to increase the flow of the fluid therethrough, and causes the free end of the rod to approach the plug to restrict flow of the fluid therethrough, respectively.

In accordance with a further feature of the invention, there is provided a thermal expansion valve assembly comprising a first tube interconnecting first and second bodies for flow of fluid from the first body to the second body, a metal second tube interconnecting a third body and the first body for flow of liquid from the third body to the first body, a portion of the second tube being disposed adjacent the first tube, and a metal rod fixed only at a first end in, and wholly contained in, the second tube, a free second end of the rod extending from the first tube and into another portion of the second tube proximate the first body. A plug having an orifice therethrough is disposed in the other portion of the second tube and proximate the free end of the rod. The metal second tube and the metal rod are provided with substantially different coefficients of expansion. Thus, thermal expansion and contraction of the second tube and the rod, caused by the temperature of the liquid in the second tube, causes the free end of the rod to retreat from the plug to increase flow of the liquid therethrough, and causes the free end of the rod to approach the plug to restrict flow of the liquid therethrough, respectively.

In accordance with a still further feature of the invention, there is provided a thermal expansion valve assembly for a refrigeration system, the assembly comprising a first tube interconnecting an evaporator and a compressor for flow of fluid from the evaporator to the compressor, and a metal second tube interconnecting a condenser and the evaporator for flow of refrigerant from the condenser to the evaporator, a portion of the second tube being disposed adjacent the first tube. A metal rod is fixed at a first end in, and extends through, the second tube and is spaced from the second tube, a free second end of the rod extending from the first tube and into another portion of the second tube proximate the evaporator. A plug having an orifice therethrough is disposed in the other portion of the second tube and proximate the free end of the rod. In operation, thermal expansion and contraction of the rod caused by the temperature of the liquid refrigerant in the second tube causes the free end of the rod to retreat from the plug orifice to increase flow of the refrigerant therethrough, and causes the free end of the rod to approach the plug orifice to restrict the flow of the refrigerant therethrough, respectively.

In accordance with a still further feature of the invention, there is provided a method for making a valve assembly, the method comprising the steps of providing a metal tube for flowing fluid therethrough, fixing a first end of a metal rod in the tube with the rod disposed wholly within the tube, the metal tube having a greater coefficient of expansion than the metal rod, and fixing a plug having an orifice therethrough in the tube proximate a free end of the rod.

The above and other features of the invention, including various novel details of construction and combinations of parts and method steps, will now be more particularly described with reference to the accompanying drawings. It will be understood that the particular device, system and method embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENTS

Figure 1:
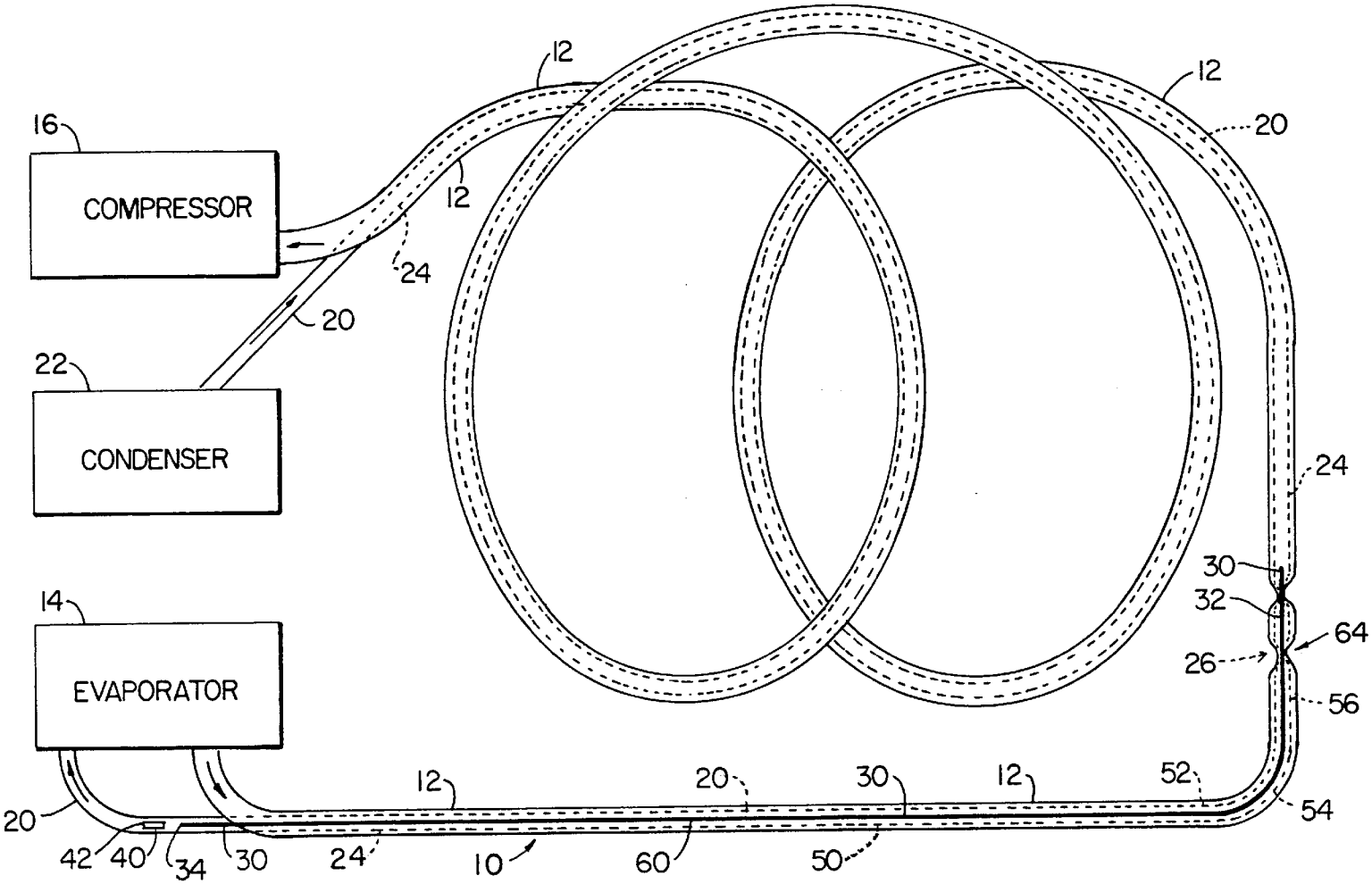
FIG. 1 is a diagrammatical presentation of one form of a valve assembly and system illustrative of an embodiment of the invention.

Referring to FIG. 1, it will be seen that an illustrative thermal expansion valve 10 is shown in combination with an assembly comprising a first tube 12, preferably of aluminum or copper, interconnecting first and second bodies, such as an evaporator 14 and a compressor 16, respectively, in a refrigeration system. The first tube 12 accommodates flow of fluid, such as liquid/vapor from the first body, or evaporator 14, to the second body, or compressor 16. In one embodiment, the first tube 12 is provided with an inside diameter of 0.340 inch and an outside diameter of 0.375 inch.

A second tube 20 interconnects a third body, such as a condenser 22 in the aforementioned refrigeration system, and the first body, or evaporator 14, for flow of liquid from the third body, or condenser 22, to the first body, or evaporator 14. A portion 24 of the second tube 20 is disposed adjacent the first tube 12, and preferably is disposed within the first tube 12, as shown in the drawings. The second tube 20 preferably is of aluminum or copper.

The valve 10 includes the tube 20 and a metal rod 30, fixed only at a first end 32 (FIGS. 1 and 2) in the tube 20 and disposed wholly within the tube 20 (FIG. 1). The metal tube 20 is provided with a coefficient of expansion substantially greater than that of the rod 30. Preferably, the rod 30 is of a material selected from nickel, tungsten, titanium, and steel. The valve 10 further includes a plug 40 having an orifice 42 therethrough (FIGS. 1 and 3), the plug 40 being disposed in the tube 20 proximate a free end 34 of the rod 30.

Figure 2:
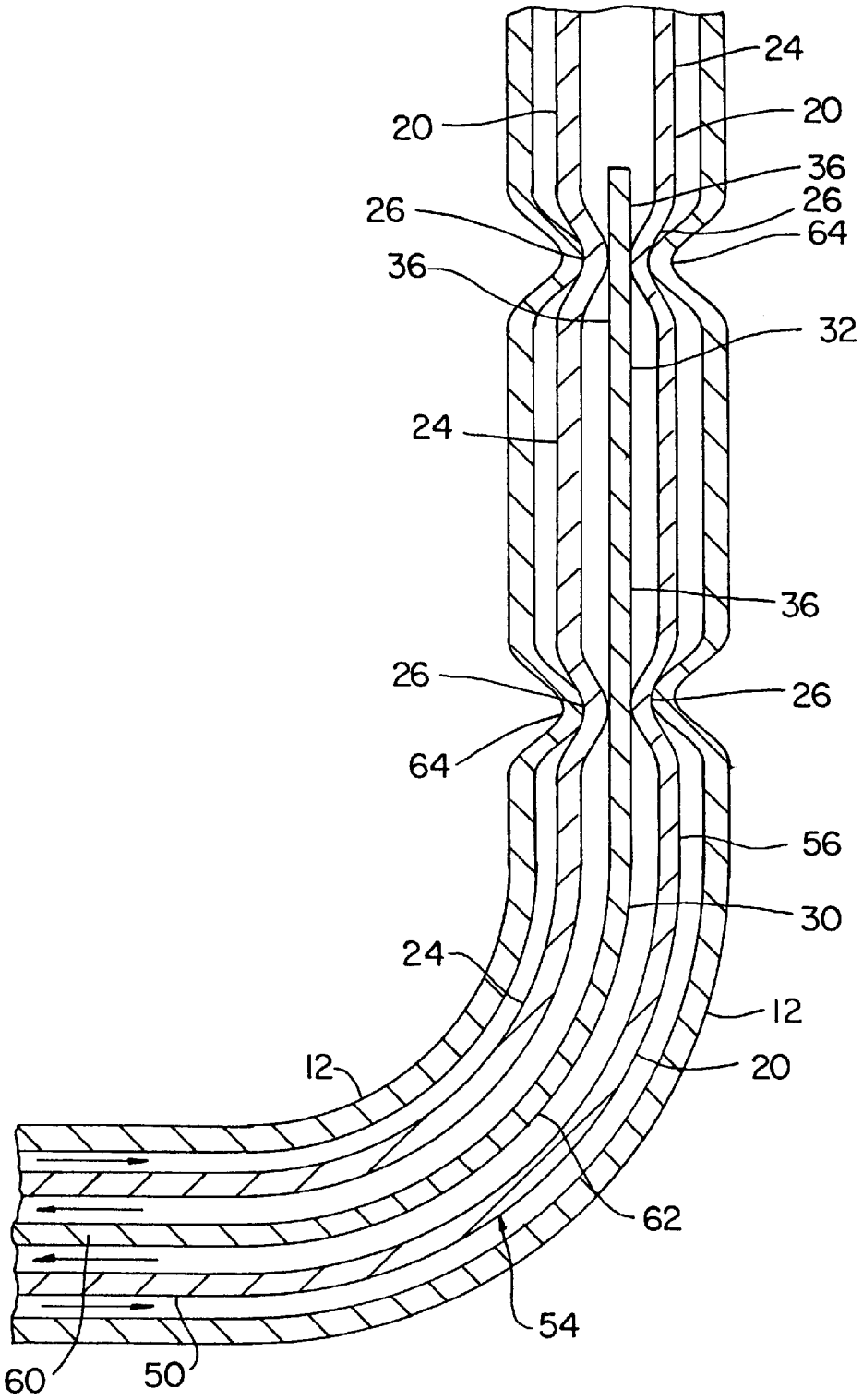
FIG. 2 is an enlarged sectional view of a portion of the system of FIG. 1.
Figure 3:
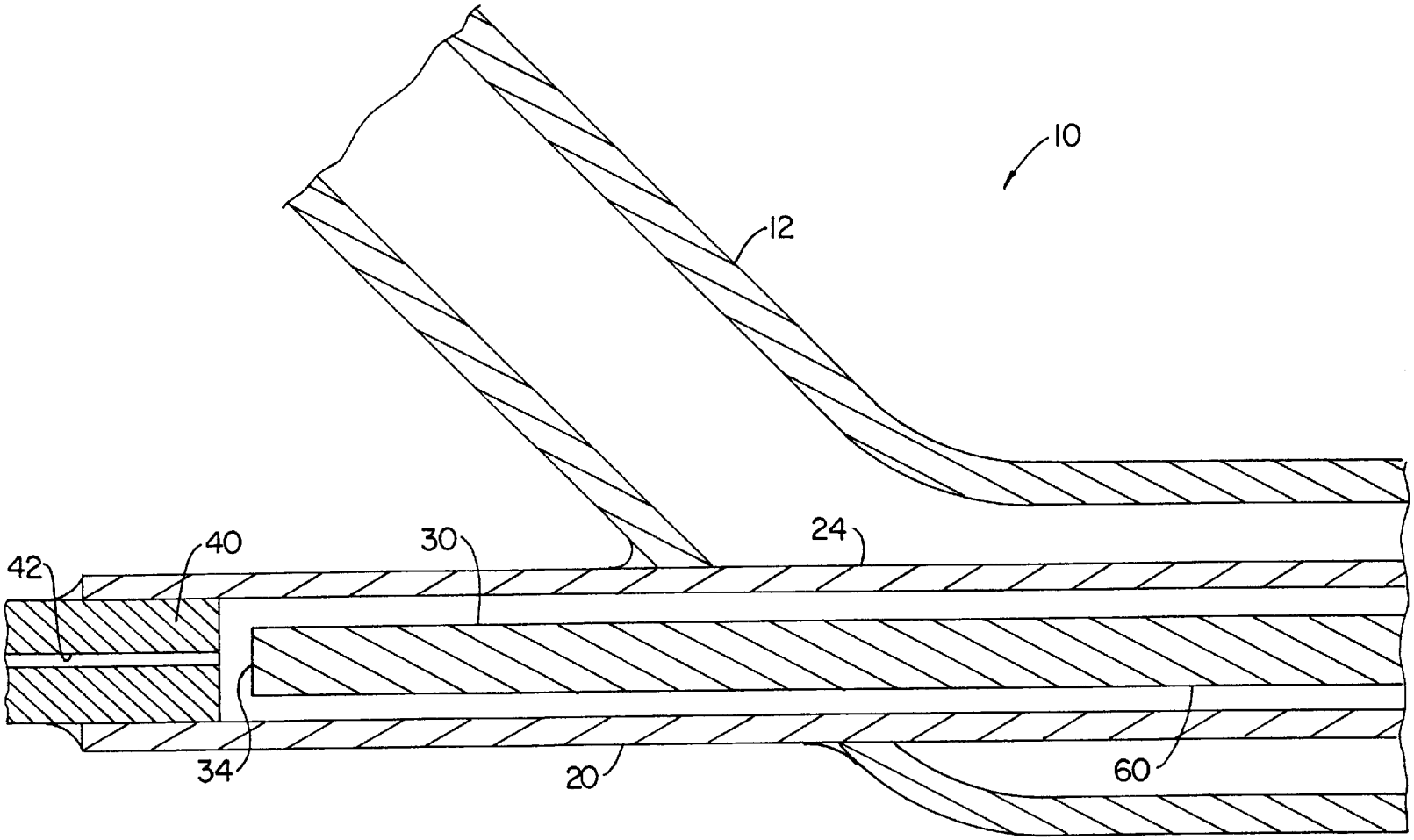
FIG. 3 is an enlarged sectional view of another portion of the system of FIG. 1.

Referring to FIGS. 1 and 2, it will be seen that the first end 32 of the rod 30 is fixed in the tube 20 at one or more locations 26 by portion 24 of the tube 20 pinched inwardly upon the rod 30 in the vicinity of the first end 32 of the rod 30. To facilitate the pinch attachment of the rod 30 to the tube 20, the rod may be provided with flat sides 36 (FIG. 2) at its first end 32, which receive the engagement by the tube 20.

The rod 30 is otherwise typically of a cylindrical configuration and in one embodiment the rod 30 is of a diameter of about 0.093 inch and is substantially centered in the tube 20, which has an inside diameter of about 0.118 inch and an outside diameter of about 0.188 inch.

The rod 30 preferably is provided with a blunt free end 34 (FIG. 3), such that the free end 34 of the rod 30, upon approach to the plug 40, operates to reduce flow to and through the orifice 42, to reduce flow to the evaporator 14.

The tube 20 (FIG. 1) includes a straight portion 50, which may be about 20–24 inches in length, and at one end 52 thereof, a bend 54 (FIGS. 1 and 2). The pinched areas 26 of portion 24 of the tube 20 are adjacent an end 56 of the tube bend 54 remote from the tube straight portion 50. The rod 30 similarly includes a straight portion 60 disposed within the tube straight portion 50, and a rod bent portion 62 (FIG. 2) disposed within the tube bend 54. The plug 40 is disposed in the tube straight portion 50 proximate the free end 34 of the rod 30. Inasmuch as the rod 30 is anchored in the tube pinched portion which extends transversely to the tube straight portion 50, any slippage of the rod 30 in the second tube portion 24 results in movement of the rod 30 transversely to the axis of the rod straight portion 60, rather than axially, thus having little effect upon the flow of fluid through the plug orifice 42.

As is shown in FIG. 2, the first tube 12 includes pinched portions 64 which coincide with the pinched areas 26 of the second tube portion 24 and serve to further retain the rod first end 32 and to hold the second tube 20 within the first tube 12.

In contraction of the tube 20 and rod 30, the tube 20 contracts to a greater degree than the rod 30, causing the plug 40 and rod free end 34 to close the gap therebetween to reduce flow of fluid through the orifice 42. However, it is contemplated that the rod end 34 never sealingly engages the plug 40, thereby always permitting a selected minimal flow of fluid through the plug 40, to avoid the possibility of the rod free end 34 binding against the plug 40 and, thereafter, being unable to move away from the plug 40 to permit resumption of flow therethrough. Total blockage of flow to the first body, or evaporator 14, could result in damage to the body.

Referring again to FIG. 1, it will be seen that the first tube 12 carries liquid and vapor from the evaporator 14 to the compressor 16. The temperature of the liquid/vapor in the first tube 12 serves to cause an increase or decrease in the temperature of the refrigerant, or other liquid, in the second tube 20. Thus, the temperature of the liquid/vapor leaving the evaporator 14 modifies the temperature of the refrigerant flowing to the evaporator 14, which refrigerant typically flashes into vapor upon passage through the plug 40. The modification of the temperature of the refrigerant in the second tube 20 changes the temperatures of the second tube 20 and the rod 30, which, in turn, automatically operates to modify the rate of flow of the refrigerant into the evaporator 14.

In operation in the context of a refrigeration system (FIG. 1), the fluid in the first tube 12 comprises liquid and vapor, the liquid being operative to cool the second tube 20 and the liquid refrigerant therein, to cause thermal contraction of the second tube 20 and the rod 30. The second tube 20 contracts at a greater rate than the rod 30, such that the plug 40 and the rod free end 34 move relatively toward each other to decrease flow of the liquid refrigerant through the plug 40, to permit the evaporator 14 to decrease in temperature and to flow therefrom the fluid having an increase in the vapor component thereof and a decrease in the liquid component thereof, whereby to reduce cooling of the liquid refrigerant in the second tube 20.

The less cooled liquid refrigerant in the second tube 20 causes thermal expansion of the second tube 20 and the rod 30, the second tube 20 expanding at a greater rate than the rod 30, such that the plug 40, and the free end 34 of the rod 30 move relatively away from each other to permit increase in flow of the liquid refrigerant through the plug 40. Such causes the evaporator 14 to increase in pressure and to flow therefrom the fluid having an increase in the liquid component thereof, whereby to increasingly cool the liquid refrigerant in the second tube 20.

Thus, the valve 10 and the system including the valve 10 automatically regulate the flow rate of the fluid flowing therethrough to maintain the body 14 to which the fluid is directed, such as an evaporator in a refrigeration or air conditioning system, at an efficiency optimum temperature. As may readily be appreciated, the valve and system is simple, reliable and inexpensive to produce, use and maintain.

In construction of the valve assembly, the first and second tubes 12, 20 are assembled with the rod 30 in the second tube 20. The assembly is bent, as at 54 and pinched, as at 64, to lock the rod 30 in the second tube 20 and the second tube 20 in the first tube 12. The assembly is then moved to a cold room (not shown) wherein the atmosphere is maintained at a temperature approximating the coldest temperature to which the valve assembly will be subjected in operation of the system for which the valve is intended. For example, for use in the usual refrigeration system, the valve assembly would be completed in a cold room at a temperature of about −10 to −20° F. The plug 40 is moved in the second tube 20 until the plug engages the end 34 of the rod 30, whereupon the plug is fixed, as by crimping and/or welding, in the tube 20. Upon removal of the valve assembly and associated tubing from the cold room, the tube 20 and rod 30 expand as the temperature therearound increases, to open a gap between the rod end 34 and the plug orifice 42. When the valve assembly is installed in a refrigeration system and placed in operation, the system reaches a maximum low temperature of near −10 to −20° F., to cause the plug 40 and rod end 34 to approach each other, to restrict flow through the orifice 42. However, since the maximum cold temperature of the system is substantially equal to the temperature at which the rod and plug were set, the plug and rod approach each other only to the point at which they initially were set in fabrication of the system. At that point, the rod end 34 contacts the plug 40, but not in a sealing engagement, such that, as noted above, a degree of flow through the plug is always present.

It is to be understood that the present invention is by no means limited to the particular construction herein disclosed and/or shown in the drawings, but also comprises any modifications or equivalents within the scope of the claims.

What is claimed is:

1. A thermal expansion valve comprising:

a metal tube having interior walls defining a flow path between two bodies for a fluid, said metal tube interior walls being disposed for contact with the fluid flowed through said flow path;

a metal rod fixed only at a first end to said tube interior walls and in said flow path defined by said tube and disposed wholly within said tube, only outer surfaces of said metal rod being disposed for contact with the fluid flowed through said tube flow path, said metal tube having a greater coefficient of expansion than said metal rod; and a plug having an orifice therethrough, said plug being fixed to said interior walls of said tube and disposed in said flow path defined by said tube proximate a free end of said rod;

wherein lengthwise thermal expansion and contraction of said tube and said rod caused by temperature of the fluid in said tube flow path and around said rod cause said free end of said rod to retreat in said flow path from said plug to increase flow of the fluid through said plug orifice, and cause said free end of said rod to move in said flow path toward said plug to restrict flow of the fluid through said plug orifice, respectively.

2. The valve in accordance with claim 1 wherein upon the expansion of said tube and said rod, said plug and said free end of said rod move in the same direction in said flow path, with said plug moving further than said rod free end, such that said plug moves away from said rod free end to increase flow through said plug orifice, and upon said contraction of said tube and said rod, said plug and said free end of said rod move in the same direction, with said plug moving further than said rod free end, such that said plug moves toward said free end of said rod to decrease flow through said plug orifice.

3. The thermal expansion valve in accordance with claim 1 wherein said free end of said rod is adapted to contact said plug in a non-sealing manner, such that flow of the fluid through said orifice is not totally blocked.

4. The valve in accordance with claim 1 wherein said plug is disposed in said tube spaced from a nearest end of said tube.

5. A thermal expansion valve assembly comprising:

a first tube interconnecting first and second bodies for flow of fluid from said first body to said second body;

a metal second tube interconnecting a third body and said first body for flow of liquid from said third body toward said first body, a first portion of said second tube being disposed adjacent said first tube;

a metal rod fixed only at a first end in, and wholly contained in said second tube, a free second end of said rod extending from said first tube and into another portion of said second tube proximate said first body; and a plug having an orifice therethrough disposed in the other portion of said second tube and proximate said free end of said rod;

said metal second tube and said metal rod having different coefficients of expansion;

whereby thermal expansion and contraction of said second tube and said rod caused by temperature of the liquid in said second tube causes said free end of said rod to retreat from said plug to increase flow of the liquid therethrough, and causes said free end of said rod to approach said plug to restrict flow of the liquid therethrough, respectively.

6. The valve assembly in accordance with claim 5 wherein said first end of said rod is fixed in said metal tube by a pinched portion of said metal tube.

7. The valve assembly in accordance with claim 6 wherein said metal tube is disposed within said first tube and wherein said first tube is pinched in upon said metal tube pinched portion.

8. The valve assembly in accordance with claim 5 wherein the fluid is a vapor/liquid fluid and an increase in vapor concentration of the fluid from said first body in said first tube is operative to decrease cooling of said second tube and the liquid in said second tube and said rod, causing expansion of said second tube and said rod, said second tube expanding at a greater rate than said rod, to cause relative movement of said plug away from said rod free end to permit increased flow of the liquid from said third body through said plug orifice where the liquid flashes into vapor which enters and increases pressure of said first body and increases liquid concentration of the fluid, the fluid flowing from said first body into said first tube.

9. The valve assembly in accordance with claim 8 wherein the increase in the liquid concentration of the fluid in said first tube is operative to cool said second tube and the liquid in said second tube and said rod, causing contraction of said second tube and said rod, said second tube contracting at a greater rate than said rod, to cause relative movement of said plug toward the rod free end to decrease flow of the liquid from said third body through said plug orifice where the liquid flashes into vapor which enters and decreases pressure in said first body and increases vapor concentration of the fluid flowing from said first body into said first tube.

10. The valve assembly in accordance with claim 5 wherein said first portion of said second tube is disposed within and spaced from said first tube.

11. The valve assembly in accordance with claim 5 wherein the valve assembly comprises a portion of a refrigeration system and wherein said first body comprises an evaporator, said second body comprises a compressor, said third body comprises a condenser, and the liquid comprises refrigerant.

12. A thermal expansion valve assembly for a refrigeration system, the assembly comprising:

a first tube interconnecting an evaporator and a compressor for flow of fluid from said evaporator to said compressor;

a metal second tube interconnecting a condenser and said evaporator, for flow of liquid refrigerant from said condenser to said evaporator;

a metal rod fixed only at a first end in, and extending through, said second tube and spaced from said second tube, a free second end of said rod extending from said first tube and into a portion of said second tube proximate said evaporator; and a plug having an orifice therethrough, said plug being disposed in said portion of said second tube and proximate said free end of said rod;

said rod and said second tube having different coefficients of expansion;

whereby thermal expansion and contraction of said rod and said second tube caused by temperature of the liquid refrigerant in said second tube causes said free end of said rod to retreat from said plug orifice to increase flow of the refrigerant therethrough, and causes said free end of said rod to approach said plug orifice to restrict flow of the refrigerant therethrough, respectively.

13. The valve assembly for a refrigeration system in accordance with claim 12 wherein said portion of said second tube extends from said first tube.

14. The valve assembly for a refrigeration system in accordance with claim 12 wherein the fluid in said first tube comprises liquid and vapor, the liquid being operative to cool said second tube and the liquid refrigerant therein, to cause thermal contraction of said second tube and said rod, said second tube contracting at a greater rate than said rod, such that said plug and said rod free end move relatively toward each other to decrease flow of the liquid refrigerant through said plug to permit said evaporator to decrease in temperature and to flow therefrom the fluid having an increase in the vapor component thereof and less liquid, whereby to increase temperature of the liquid refrigerant in said second tube.

15. The valve assembly for a refrigeration system in accordance with claim 14 wherein warming of the liquid refrigerant in said second tube causes thermal expansion of said second tube and said rod, said second tube expanding at a greater rate than said rod, such that said plug and said free end of said rod move relatively away from each other to permit increase in flow of the liquid refrigerant through said plug, to cause said evaporator to increase in temperature and to flow therefrom the fluid having an increase in the liquid component thereof, whereby to cool the liquid refrigerant in said second tube.

* * * * *